US006739391B2

(12) United States Patent
McMahan

(10) Patent No.: US 6,739,391 B2
(45) Date of Patent: May 25, 2004

(54) SURFACE DEPLOYED CEMENT SEPARATION PLUG

(75) Inventor: Michael E. McMahan, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 67 days.

(21) Appl. No.: 09/974,995

(22) Filed: Oct. 10, 2001

(65) Prior Publication Data

US 2003/0066648 A1 Apr. 10, 2003

(51) Int. Cl.[7] ..... E21B 33/16

(52) U.S. Cl. ..... 166/153; 166/291; 166/156; 166/177.3; 166/177.4; 166/312

(58) Field of Search ..... 166/177.3, 177.4, 166/312, 153, 291, 156, 285

(56) References Cited

U.S. PATENT DOCUMENTS

| | | | | |
|---|---|---|---|---|
| 1,369,891 A | | 3/1921 | Halliburton | |
| 2,187,483 A | | 1/1940 | Baker | |
| 2,344,120 A | | 3/1944 | Baker | |
| 2,602,511 A | | 7/1952 | Johnson | |
| 2,800,185 A | | 7/1957 | Teplitz | |
| 3,001,585 A | | 9/1961 | Shiplet | |
| 3,524,503 A | | 8/1970 | Baker | |
| 3,570,603 A | * | 3/1971 | Kammerer et al. | 166/290 |
| 3,633,673 A | | 1/1972 | Conrad | |
| 3,756,316 A | | 9/1973 | Van Ruth | |
| 4,671,358 A | | 6/1987 | Lindsey, Jr. et al. | |
| 5,018,579 A | | 5/1991 | Braddick et al. | |
| 5,469,918 A | | 11/1995 | Haberman | |
| 5,667,015 A | | 9/1997 | Harestad et al. | |
| 5,732,775 A | | 3/1998 | Hudson et al. | |
| 5,762,139 A | | 6/1998 | Sullaway et al. | |
| 6,050,336 A | | 4/2000 | Willauer et al. | |
| 6,523,612 B2 | * | 2/2003 | Reynolds | 166/312 |
| 2002/0139529 A1 | * | 10/2002 | Fraser et al. | 166/291 |
| 2002/0144812 A1 | * | 10/2002 | Smith | 166/177.3 |

FOREIGN PATENT DOCUMENTS

| | | |
|---|---|---|
| EP | 0 141 726 A2 | 5/1985 |

* cited by examiner

*Primary Examiner*—David Bagnell
*Assistant Examiner*—Giovanna M. Collins
(74) *Attorney, Agent, or Firm*—Gerald W. Spinks

(57) ABSTRACT

A separation barrier for placement in an open well bore or casing, to prevent migration of cement slurry downwardly into the drilling fluid, facilitating the placement of a cement plug to segregate a well bore into uphole and downhole portions. The barrier has an annular seal which facilitates pumping the barrier downhole through a work string to a desired location. The separation barrier also has a plurality of flexible elongated elements which expand outwardly when the barrier exits the work string. The elongated elements are closely spaced to prevent migration or contamination of cement slurry therebetween. The barrier can also have a shearable landing ring for providing positive indication of placement of the barrier at the desired location.

27 Claims, 1 Drawing Sheet

SURFACE DEPLOYED CEMENT SEPARATION PLUG

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of devices used in placing a cement plug in an open hole well bore, or in a casing in a well bore.

2. Background Art

It is sometimes desirable to segregate an uphole portion of a well bore from an adjacent downhole portion. Typically, the well bore or casing is full of drilling fluid having a density calculated to balance the formation pressure. Cement slurry is pumped to the location where the operator desires to segregate the well bore. A cement plug is deposited at this location and left to hydrate or harden. Usually, the density of the cement slurry is greater than the density of the drilling fluid. So, the cement tends to drift or migrate downwardly in the well bore, with the result that the cement plug is formed at a deeper location than desired. Further, because of this migration of the cement slurry into the drilling fluid, drilling fluid can flow upwardly through the cement slurry, and the cement plug formed may not completely extend across the diameter of the well bore. Still further, mixing of the drilling fluid with the cement may contaminate the cement plug and reduce its strength. Therefore, when a well bore or casing is to be plugged with cement, it is desirable to be able to limit or eliminate the migration or contamination of the cement slurry.

One known remedy for the cement migration or contamination problem is to place a barrier at the desired location for the cement plug, and then to place the cement slurry on top of the barrier. The barrier might be a mechanical apparatus or a jelled plug. Such mechanical barrier devices usually suffer from the disadvantage that the exact configuration and dimensions of the hole must be known, so they must be installed in a cased hole. Jelled barriers may take a long time to set up before the cement slurry can be placed. At least one mechanical barrier is also known, which consists of two sets of thin strips of metal, one angled uphole and one angled downhole, which flex and press outwardly against the walls of the bore hole or casing. This device relies upon additional uphole and downhole pumpable plugs to pump the barrier into position, and it is often difficult to determine when the barrier has been placed at the desired location. Further, because the device is centered only by the two sets of flexed metal strips, it may not be accurately centered in the hole. Finally, because of the downhole set of flexible strips, this device can become snagged in some types of work string.

BRIEF SUMMARY OF THE INVENTION

The present invention comprises a pumpable barrier which has a plurality of flexible elongated flat strips, and an annular seal for sealing against the bore hole wall. The annular seal, which can be mounted at the uphole or downhole end of the barrier, provides a fluid barrier against which hydraulic pressure can be applied, to pump the barrier downhole, through a work string, to the desired location. This eliminates the need for pumpable plugs to be used to place the barrier downhole. The plurality of elongated flat strips are attached, at one end, to the body of the barrier, with their free ends being oriented toward the trailing end of the barrier. This allows the barrier to be pumped through any type of work string without snagging. The flat strips can be constricted closely to the body of the barrier, to allow pumping of the barrier through the work string, or they can be allowed to flex outwardly, to contact and press against the wall of the well bore. Once the barrier has been pumped downhole to the desired location, it exits the end of the work string, and the elongated strips are released to flex outwardly. Cement slurry placed above the barrier will not migrate through the barrier, because the spacing between the flat strips is too small to allow the passage of the viscous slurry. This allows the cement plug to completely set up, at the desired location, completely covering the cross section of the casing or well bore.

If desired, the barrier can be landed in a landing sub at the downhole end of the work string, then released from the landing sub by the shearing of a shearable device, such as a shear pin. Landing of the barrier in the landing sub results in an increase in pressure, signaling the operator that the barrier has reached the desired location. Release of the barrier from the landing sub results in a decrease in pressure, signaling the operator that the barrier has been put in place.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
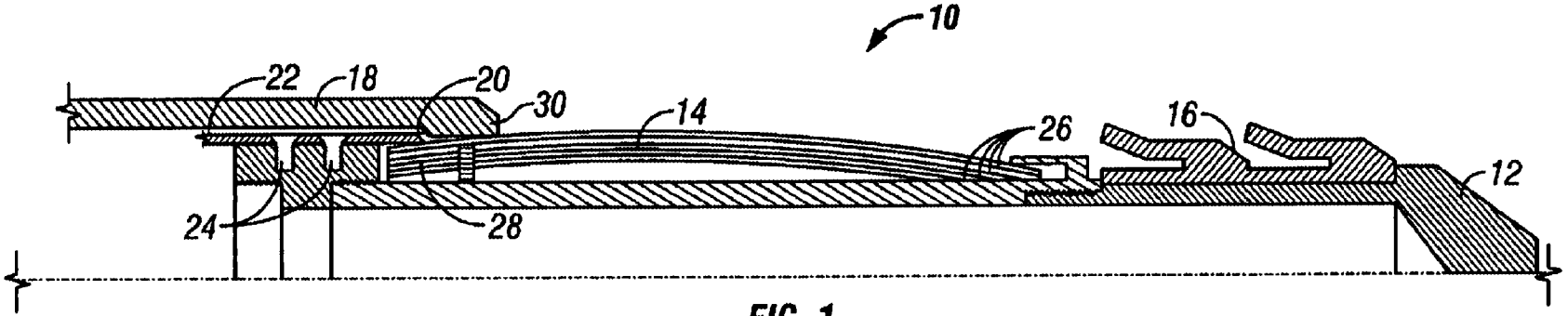
FIG. 1 is a longitudinal section view of a first embodiment of the present invention, with flat strip elements and a leading annular seal, showing the strip elements in a constricted orientation.

As shown in FIG. 1, the separation barrier 10 of the present invention includes a generally cylindrical barrier body 12, a plurality of elongated flexible elements 14, and an annular fluid seal 16 on the perimeter of the body 12. The body 12 can be one piece or multi-piece, as shown. The elongated fluid separation elements 14 can be a plurality of closely spaced, overlapping flat strips of flexible material, as shown, or other expandable elements which can be arranged and spaced to prevent the migration of cement slurry therebetween. Leading ends 26 of the elongated elements 14 are attached circumferentially around the perimeter of the body 12, while trailing ends 28 of the elongated elements 14 are free to expand or flex generally radially outwardly. The elongated elements 14 are outwardly biased, either by their own stiffness or by additional biasing means. The elongated elements 14 are constrained to the constricted orientation shown in FIG. 1 before the barrier 10 is placed into the work string at the well site.

The annular fluid seal 16 can be mounted either adjacent the leading end of the body 12, as shown, or it can be mounted adjacent the trailing end of the body 12. The annular fluid seal 16 shown consists of a double swab cup of flexible material such as rubber. The annular fluid seal 16 has an outer diameter greater than the outer diameter of the constricted elongated elements 14, and a sufficiently great diameter to achieve a fluid seal against the inner diameter of a work string 18, to facilitate the pumping of the barrier 10 through the work string 18 without the use of separate pumpable plugs.

Figure 2:
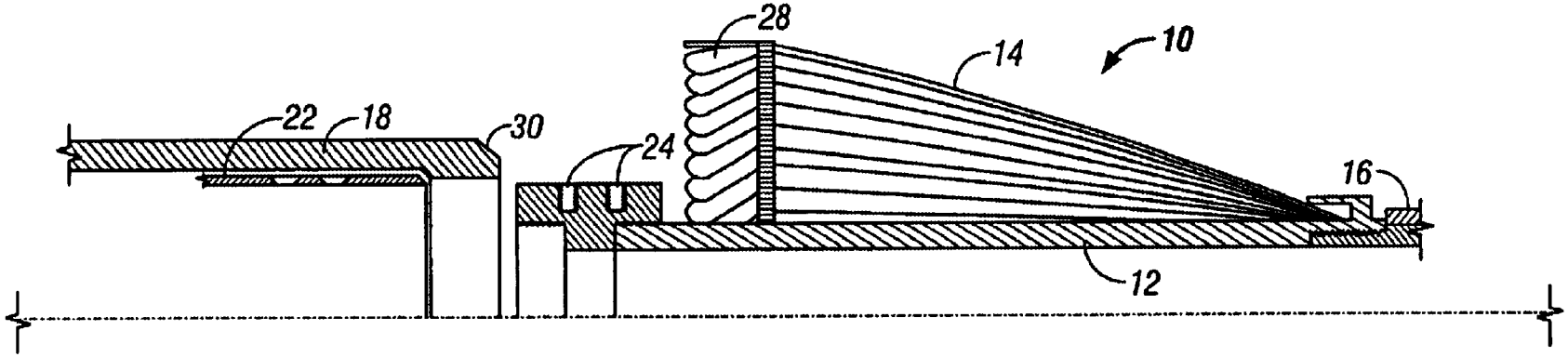
FIG. 2 is a longitudinal section view of the embodiment shown in FIG. 1, showing the strip elements in an expanded orientation.

The work string 18 can have a landing shoulder 20 inside a landing sub at its lower end 30. Further, the body 12 of the barrier 10 can have a landing ring 22 shearably attached thereto by means of one or more shear screws or pins 24. The landing ring 22 is shown attached to the trailing end of the body 12, but it could also be attached to the leading end. The barrier 10 and its components are sized and configured to be pumped downhole through the work string 18 until the landing ring 22 lands in the landing shoulder 20. Since the barrier 10 completely plugs the work string 18 at this point, this results in an increase in drilling fluid backpressure which is a positive indication to the operator that the barrier 10 is at the lower end 30 of the work string 18. The operator will have positioned the lower end 30 of the work string 18 at the desired location for deployment of the barrier 10, by known methods. The operator can then allow the drilling fluid pressure to increase until the shear pins 24 are sheared, releasing the barrier body 12 from the landing ring 22, and allowing the barrier 10 to exit the lower end 30 of the work string 18, as shown in FIG. 2. This allows drilling fluid to exit the work string into the larger well bore, resulting in a decrease in the fluid backpressure. This decrease in backpressure is a positive indication to the operator that the barrier 10 has been deployed at the desired location.

As the barrier 10 is deployed from the lower end 30 of the work string 18, the free ends 28 of the flexible elongated elements 14 expand outwardly toward the well bore, as shown in FIG. 2. The flat strips of elongated elements 14 are closely spaced or overlapping, thereby minimizing or preventing the migration of cement slurry therebetween. The expanded elongated elements 14 can also press against the wall of the well bore with sufficient force to centralize the barrier body 12 in the well bore, insuring complete blockage of the cement slurry. Cement slurry placed above, or uphole from, the barrier 10, with the elongated elements 14 in this expanded orientation, will stay in place long enough to set up, thereby effectively segregating the uphole portion of the well bore from the downhole portion.

If desired, two or more such barriers may be pumped downhole successively, to prevent migration or contamination of cement plugs at various depths.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A separation barrier for preventing contamination of cement slurry by other fluid in a well bore, comprising:

a substantially cylindrical body, said body having a leading end and a trailing end;

a plurality of elongated elements arranged on the exterior of said body, each said elongated element having at least one end attached to said body; and an annular fluid seal mounted on the exterior of said body, said fluid seal having an outer diameter greater than the outer perimeter of said body, said fluid seal being adapted to seal against a work string;

wherein said plurality of elongated elements are biased to move from a constricted orientation, wherein said plurality of elongated elements lie closer to said body than said outer diameter of said annular seal, to an expanded orientation, wherein said plurality of elongated elements are angled toward an end of said body and outwardly from said body beyond said outer diameter of said annular seal; and wherein said plurality of elongated elements are flexible.

2. The barrier recited in claim 1, further comprising a free end on each said elongated element.

3. The barrier recited in claim 1, wherein said plurality of elongated elements comprise a plurality of flat elongated strips.

4. The barrier recited in claim 1, wherein said annular fluid seal comprises at least one swab cup.

5. The barrier recited in claim 1, wherein, in an unconstrained state, all of said plurality of elongated elements are angled from said attached end toward said trailing end of said body.

6. The barrier recited in claim 1, wherein said plurality of elongated elements are circumferentially spaced around the exterior of said body.

7. A separation barrier for preventing contamination of cement slurry by other fluid in a well bore, comprising:

a substantially cylindrical body, said body having a leading end and a trailing end;

a plurality of elongated elements arranged on the exterior of said body, each said elongated element having at least one end attached to said body; and an annular fluid seal mounted on the exterior of said body, said fluid seal having an outer diameter greater than the outer perimeter of said body, said fluid seal being adapted to seal against a work string;

wherein said plurality of elongated elements are biased to move from a constricted orientation, wherein said plurality of elongated elements lie closer to said body than said outer diameter of said annular seal, to an expanded orientation, wherein said plurality of elongated elements are angled toward an end of said body and outwardly from said body beyond said outer diameter of said annular seal; and wherein said annular fluid seal is mounted adjacent said leading end of said body.

8. The barrier recited in claim 7, further comprising a free end on each said elongated element.

9. The barrier recited in claim 7, wherein said plurality of elongated elements comprise a plurality of flat elongated strips.

10. The barrier recited in claim 7, wherein said annular fluid seal comprises at least one swab cup.

11. The barrier recited in claim 7, wherein, in an unconstrained state, all of said plurality of elongated elements are angled from said attached end toward said trailing end of said body.

12. The barrier recited in claim 7, wherein said plurality of elongated elements are circumferentially spaced around the exterior of said body.

13. A separation barrier for preventing contamination of cement slurry by other fluid in a well bore, comprising:

a substantially cylindrical body, said body having a leading end and a trailing end;

a plurality of elongated elements arranged on the exterior of said body, each said elongated element having at least one end attached to said body;

an annular fluid seal mounted on the exterior of said body, said fluid seal having an outer diameter greater than the outer perimeter of said body, said fluid seal being adapted to seal against a work string; and a releasable landing device mounted to said body, said landing device being adapted to engage a landing sub in a work string;

wherein said plurality of elongated elements are biased to move from a constricted orientation, wherein said plurality of elongated elements lie closer to said body than said outer diameter of said annular seal, to an expanded orientation, wherein said plurality of elongated elements are angled toward an end of said body and outwardly from said body beyond said outer diameter of said annular seal.

14. The barrier recited in claim 13, wherein said landing device comprises a landing ring mounted to said body.

15. The barrier recited in claim 14, wherein said landing ring is mounted to said body with at least one shearable device.

16. The barrier recited in claim 15, wherein said at least one shearable device comprises a shear pin.

17. The barrier recited in claim 13, further comprising a free end on each said elongated element.

18. The barrier recited in claim 13, wherein said plurality of elongated elements comprise a plurality of flat elongated strips.

19. The barrier recited in claim 13, wherein said annular fluid seal comprises at least one swab cup.

20. The barrier recited in claim 13, wherein, in an unconstrained state, all of said plurality of elongated elements are angled from said attached end toward said trailing end of said body.

21. The barrier recited in claim 13, wherein said plurality of elongated elements are circumferentially spaced around the exterior of said body.

22. A method for preventing contamination of cement slurry by other fluid in a well bore, comprising:

providing a separation barrier, said separation barrier having an annular fluid seal and a plurality of flexible elongated elements, each said elongated element being attached to the body of said separation barrier at a first end;

flexing a second end of each said elongated element toward the body of said separation barrier, thereby constraining said plurality of elongated elements in a first orientation, wherein each said elongated element lies closer to the body of said separation barrier than an outer diameter of said annular seal;

inserting said constrained separation barrier into a work string, with said annular seal contacting an inner diameter of said work string in a sealing engagement, and with said second end of each said elongated element extending toward a trailing end of said separation barrier;

applying fluid pressure to said work string above said separation barrier to drive said separation barrier through said work string and out a lower end of said work string;

biasing each said elongated element to move to a second orientation, wherein each said elongated element is angled upwardly and outwardly from the body of said separation barrier beyond said outer diameter of said annular seal to contact a well bore; and placing a cement slurry in the well bore above said separation barrier.

23. The method recited in claim 22, further comprising:

landing said separation barrier in a landing sub adjacent said lower end of said work string; and releasing said separation barrier from said landing sub to exit said lower end of said work string.

24. A method for preventing contamination of cement slurry by other fluid in a well bore, comprising:

providing a separation barrier, said separation barrier having an annular fluid seal and a plurality of flexible elongated elements, each said elongated element being attached to the body of said separation barrier at a first end;

constraining said plurality of elongated elements in a first orientation, wherein each said elongated element lies closer to the body of said separation barrier than an outer diameter of said annular seal;

inserting said constrained separation barrier into a work string, with said annular seal contacting an inner diameter of said work string in a sealing engagement, and with a second end of each said elongated element extending toward a trailing end of said separation barrier;

applying fluid pressure to said work string above said separation barrier to drive said separation barrier through said work string;

landing said separation barrier in a landing sub adjacent said lower end of said work string;

releasing said separation barrier from said landing sub to exit said lower end of said work string;

biasing each said elongated element to move to a second orientation, wherein each said elongated element is angled upwardly and outwardly from the body of said separation barrier beyond said outer diameter of said annular seal to contact a well bore; and placing a cement slurry in the well bore above said separation barrier;

wherein said releasing of said separation barrier from said landing sub comprises increasing fluid pressure in said work string to shear a shearable device on said separation barrier.

25. A method for preventing contamination of cement slurry by other fluid in a well bore, comprising:

providing a separation barrier, said separation barrier having an annular fluid seal and a plurality of flexible elongated elements, each said elongated element being attached to the body of said separation barrier at a first end;

constraining said plurality of elongated elements in a first orientation, wherein each said elongated element lies closer to the body of said separation barrier than an outer diameter of said annular seal;

inserting said constrained separation barrier into a work string, with said annular seal contacting an inner diameter of said work string in a sealing engagement, and with a second end of each said elongated element extending toward a trailing end of said separation barrier;

applying fluid pressure to said work string above said separation barrier to drive said separation barrier through said work string;

landing said separation barrier in a landing sub adjacent said lower end of said work string;

detecting said landing of said separation barrier in said landing sub by detecting a fluid pressure increase in said work string;

releasing said separation barrier from said landing sub to exit said lower end of said work string;

biasing each said elongated element to move to a second orientation, wherein each said elongated element is angled upwardly and outwardly from the body of said separation barrier beyond said outer diameter of said annular seal to contact a well bore; and placing a cement slurry in the well bore above said separation barrier.

26. A method for preventing contamination of cement slurry by other fluid in a well bore, comprising:

providing a separation barrier, said separation barrier having an annular fluid seal and a plurality of flexible elongated elements, each said elongated element being attached to the body of said separation barrier at a first end;

constraining said plurality of elongated elements in a first orientation, wherein each said elongated element lies closer to the body of said separation barrier than an outer diameter of said annular seal;

inserting said constrained separation barrier into a work string, with said annular seal contacting an inner diameter of said work string in a sealing engagement, and with a second end of each said elongated element extending toward a trailing end of said separation barrier;

applying fluid pressure to said work string above said separation barrier to drive said separation barrier through said work string;

landing said separation barrier in a landing sub adjacent said lower end of said work string;

releasing said separation barrier from said landing sub to exit said lower end of said work string;

detecting said releasing of said separation barrier from said landing sub by detecting a fluid pressure decrease in said work string;

biasing each said elongated element to move to a second orientation, wherein each said elongated element is angled upwardly and outwardly from the body of said separation barrier beyond said outer diameter of said annular seal to contact a well bore; and placing a cement slurry in the well bore above said separation barrier.

27. The method recited in claim 22, further comprising:

providing a second separation barrier, said second separation barrier having an annular fluid seal and a plurality of flexible elongated elements, each said elongated element being attached to the body of said second separation barrier at a first end;

flexing a second end of each said elongated element toward the body of said second separation barrier, thereby constraining said plurality of elongated elements in a first orientation, wherein each said elongated element lies closer to the body of said second separation barrier than an outer diameter of said annular seal;

inserting said constrained second separation barrier into a work string, with said annular seal contacting an inner diameter of said work string in a sealing engagement, and with said second end of each said elongated element extending toward a trailing end of said second separation barrier;

applying fluid pressure to said work string above said second separation barrier to drive said second separation barrier through said work string and out a lower end of said work string; and biasing each said elongated element to move to a second orientation, wherein each said elongated element is angled upwardly and outwardly from the body of said second separation barrier beyond said outer diameter of said annular seal to contact a well bore.

* * * * *